US007643045B2

(12) United States Patent
Chan et al.

(10) Patent No.: US 7,643,045 B2
(45) Date of Patent: Jan. 5, 2010

(54) THERMAL PRINTING APPARATUS AND PRINTING METHODS THEREOF

(75) Inventors: Cho-Yu Chan, Taipei (TW); Chih-Wei Huang, Tainan County (TW)

(73) Assignee: Lite-On Technology Corp., Taipei (TW)

( * ) Notice: Subject to any disclaimer, the term of this patent is extended or adjusted under 35 U.S.C. 154(b) by 412 days.

(21) Appl. No.: 11/750,308

(22) Filed: May 17, 2007

(65) Prior Publication Data

US 2008/0084468 A1 Apr. 10, 2008

(51) Int. Cl.
*B41J 2/35* (2006.01)

(52) U.S. Cl. ..... 347/211; 347/183

(58) Field of Classification Search ..... 347/171, 347/211, 183; 400/120.01, 120.07
See application file for complete search history.

(56) References Cited

U.S. PATENT DOCUMENTS 5,255,351 A * 10/1993 Takanashi et al. ..... 358/1.9

* cited by examiner

*Primary Examiner*—Huan H Tran
(74) *Attorney, Agent, or Firm*—Rosenberg, Klein & Lee

(57) ABSTRACT

Thermal printing apparatus and printing methods thereof are disclosed. One of the proposed printing methods includes: providing an n-bit value corresponding to a pixel, wherein a color level of the pixel ranges from 0 to $2^n-1$; determining a total print time corresponding to a target bit of the n-bit value according to the bit significance of the target bit; and if the target bit is of a predetermined value, intermittently driving a heating unit to heat a ribbon within the print time corresponding to the target bit.

21 Claims, 4 Drawing Sheets

THERMAL PRINTING APPARATUS AND PRINTING METHODS THEREOF

BACKGROUND OF THE INVENTION

1. Field of the Invention

The invention relates to thermal printing techniques, and more particularly, to thermal printing apparatus and printing methods thereof.

2. Description of the Prior Art

In general, image printing techniques can be classified into four major categories: dot matrix printing technique, inkjet printing technique, laser printing technique, and thermal printing technique. The thermal printing technique can be classified into two categories of direct thermal printing technique and thermal transfer printing technique, wherein the thermal transfer printing technique includes thermal sublimation printing technique and thermal wax printing technique. Taking the thermal transfer printing technique as an example, the thermal transfer printing technique has a better output image quality than other printing techniques due to the fact that the thermal transfer printing technique can possess continuous tone printing performance. It is well known that the thermal transfer printer utilizes a thermal print head to heat ribbons containing dyes in order to transfer the dyes onto an object to be printed. In this way, continuous-tone can be formed on the object according to the heating time or the heating temperature.

In the conventional techniques, if the thermal transfer printer is required to output an image having 256 color levels, a controlling circuit of the thermal transfer printer has to transfer printing data of all the pixels on every row image to 256 color levels, and transmit the 256 color levels to the thermal print head 256 times sequentially. Then, the thermal print head will perform a printing operation 256 times according to the 256 color levels, in order to complete the printing procedure of the row image. During the above-mentioned printing operation, quite a large amount of color levels are required to be transmitted between the controlling circuit and the thermal print head. The transmission operation of these color levels not only costs time, but also results in more loadings on the firmware control of the thermal transfer printer, and further affects the whole printing efficiency of the thermal transfer printer.

SUMMARY OF THE INVENTION

It is therefore one of the objectives of the present invention to provide thermal printing apparatus and printing methods thereof to solve the above problems.

According to an embodiment of the present invention, a printing method of a thermal printing apparatus is disclosed. The printing method comprises: providing an n-bit value corresponding to a color level of a pixel, wherein the color level of the pixel ranges from 0 to $2^n-1$; determining a total print time corresponding to a target bit of the n-bit value according to the bit significance of the target bit; and if the target bit is of a predetermined value, intermittently driving a heating unit to heat a ribbon within the print time corresponding to the target bit.

According to an embodiment of the present invention, a thermal printing apparatus is further disclosed. The thermal printing apparatus comprises: a thermal print head comprising a heating unit; and a controlling circuit, for providing an n-bit value corresponding to a color level of a pixel and determining a print period corresponding to a target bit of the n-bit value according to a bit significance of the target bit, wherein the color level of the pixel ranges from 0 to $2^n-1$; wherein if the target bit is of a predetermined value, the controlling circuit intermittently drives the heating unit to heat a ribbon within the print period.

According to an embodiment of the present invention, another thermal printing apparatus is further disclosed. The thermal printing apparatus comprises: a thermal print head comprising a heating unit; and a controlling circuit, for providing an n-bit value corresponding to a color level of a pixel and determining a total print time corresponding to a target bit of the n-bit value according to a bit significance of the target bit and dividing the total print time into a plurality of discrete print periods, wherein the color level of the pixel ranges from 0 to $2^n-1$; wherein if the target bit is of a predetermined value, the controlling circuit intermittently drives the heating unit to heat a ribbon within the plurality of print periods.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular components. As one skilled in the art will appreciate, manufacturers may refer to a component by different names. This document does not intend to distinguish between components that differ in name but in function. In the following discussion and in the claims, the terms "include", "including", "comprise", and "comprising" are used in an open-ended fashion, and thus should be interpreted to mean "including, but not limited to . . . " The terms "couple" and "coupled" are intended to mean either an indirect or a direct electrical connection. Thus, if a first device couples to a second device, that connection may be through a direct electrical connection, or through an indirect electrical connection via other devices and connections.

Figure 1:
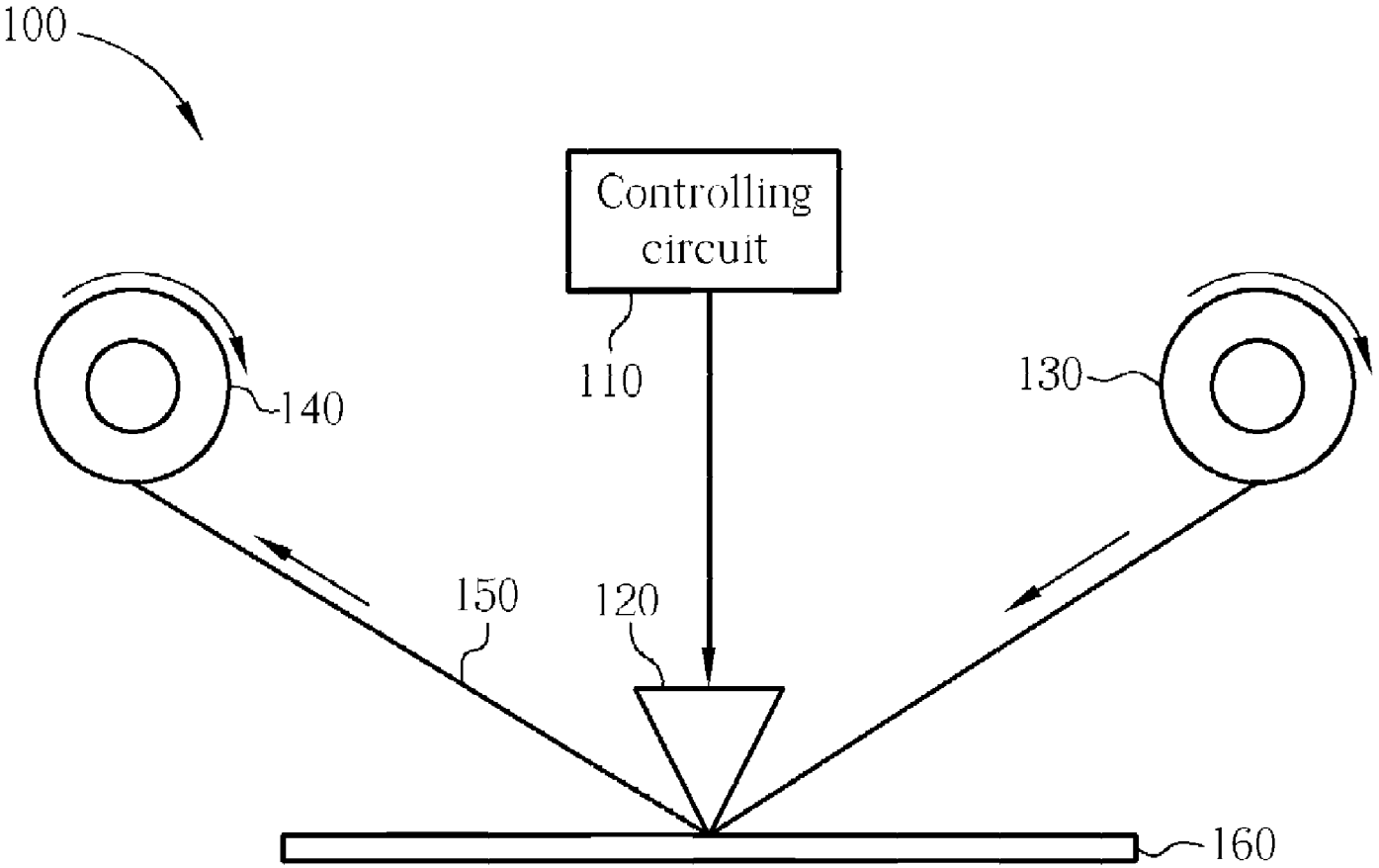
FIG. 1 shows a simplified block diagram of a thermal printing apparatus according to an embodiment of the present invention.

Please refer to FIG. 1. FIG. 1 shows a simplified block diagram of a thermal printing apparatus 100 according to an embodiment of the present invention. As shown in FIG. 1, the thermal printing apparatus 100 includes a controlling circuit 110, a thermal print head 120, a ribbon supplying port 130 and a ribbon takeup port 140. The thermal print head 120 includes a plurality of heating elements (not shown) utilized for heating a ribbon 150. In general, every heating element is utilized for heating an area corresponding to a pixel in the ribbon 150. During operation, the ribbon 150 will move from the ribbon supplying port 130 toward the ribbon takeup port 140, and the thermal print head 120 will selectively drive the heating elements to heat the ribbon 150 according to color level data transmitted from the controlling circuit 110, in order to make dyes on the ribbon 150 be transferred and printed onto a target medium 160 (such as a paper or a card), so as to achieve the purpose of image printing.

In color printing applications, the dye blocks of different colors are disposed on the ribbon 150 sequentially, and these dye blocks are usually circularly arranged in an order of yellow, magenta, cyan, and over coating. The ribbon takeup port 140 will take up the used ribbon by the thermal print head 120. In practice, both the ribbon supplying port 130 and the ribbon takeup port 140 can be realized by utilizing wheels, but this is not a limitation of the present invention. A further description for explaining the operation of the thermal printing apparatus 100 with FIG. 2 is provided in the following paragraphs.

Figure 2:
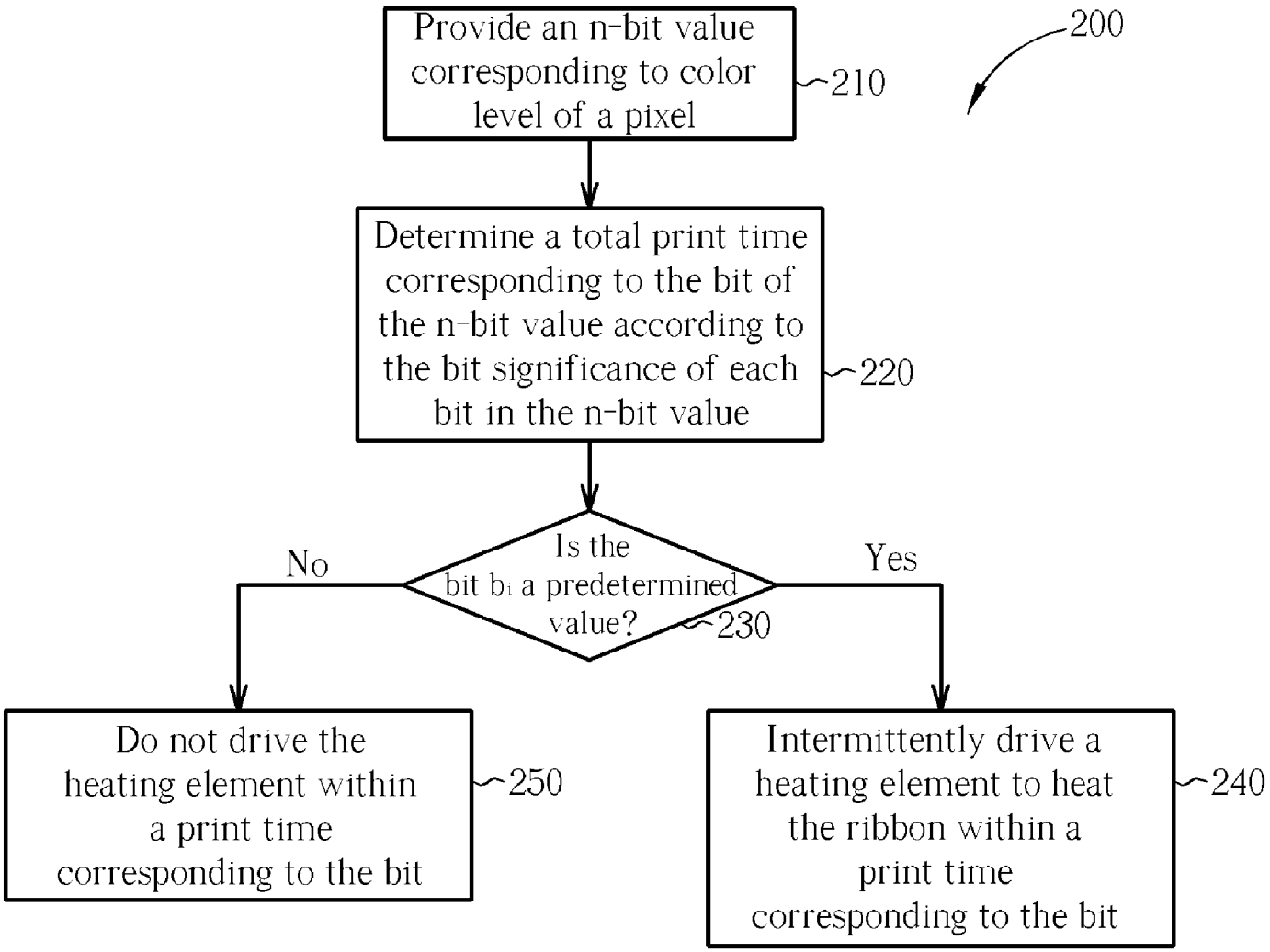
FIG. 2 is a flow chart showing a thermal printing method according to a first embodiment of the present invention.

Please refer to FIG. 2. FIG. 2 is a flow chart 200 showing a thermal printing method according to a first embodiment of the present invention. Since the driving mode of each heating element of the thermal print head 120 is very similar, only the driving mode of a single heating element is described in the following paragraphs for the sake of brevity. The flow chart 200 includes the following steps:

In step 210, the controlling circuit 110 of the thermal printing apparatus 100 provides an n-bit value for representing a color level of a pixel to the thermal print head 120, wherein the color level of the pixel ranges from 0 to $2^n-1$. For example, if the color level of the pixel ranges from 0 to 255, n is equal to 8, and if the color level of the pixel ranges from 0 to 511, n is equal to 9. In this embodiment, the n-bit value is $b_n b_{n-1} b_{n-2} \ldots b_1$, wherein $b_n$ is a most significant bit (MSB), and $b_1$ is a least significant bit (LSB). Assuming n is equal to 8, if the color level of the pixel is 0, the n-bit value is 00000000; if the color level of the pixel is 128, the n-bit value is 10000000; if the color level of the pixel is 255, the n-bit value is 11111111, and so on. The controlling circuit 110 can utilize a serial transmission mode or a parallel transmission mode for transmitting the n-bit value to the thermal print head 120.

In practice, the n-bit value can be generated by the controlling circuit 110 according to image data on the target medium 160, or data received by the controlling circuit 110 from an external apparatus (such as a computer or a camera, etc.). In addition, the controlling circuit 110 can be a microprocessor in the thermal printing apparatus 100, or an Application Specific Integrated Circuit (ASIC) specifically designed for realizing the abovementioned functions.

In step 220, the controlling circuit 110 will determine a total print time $T_i$ corresponding to a bit $b_i$ of the n-bit value according to the bit significance of each bit $b_i$ in the n-bit value. Since each bit in the n-bit value has different bit significance, the total print time corresponding to each bit is different. For example, the total print time $T_i$ corresponding to each bit $b_i$ is twice the length of a total print time $T_{i-1}$ corresponding to an adjacent bit $b_{i-1}$ of substantially lower bit significance in this embodiment. Therefore, a total print time $T_2$ corresponding to a bit $b_2$ is twice the length of a total print time $T_1$ substantially corresponding to a bit $b_1$; a total print time $T_3$ corresponding to a bit $b_3$ is twice the length of the total print time $T_2$; a total print time $T_4$ corresponding to a bit $b_4$ is twice the length of the total print time $T_3$, and so on. It is known from the above-mentioned description that a total print time $T_n$ corresponding to the MSB $b_n$ is $2^n-1$ times longer than the total print time $T_1$ substantially corresponding to the LSB $b_1$.

In this embodiment, the controlling circuit 110 will determine a print period Pi corresponding to the bit bi according to the total print time Ti corresponding to the bit bi.

In step 230, the controlling circuit 110 will determine the sequential operation according to the value of each bit $b_i$. If the bit $b_i$ is a predetermined value, then the thermal print head 120 will perform step 240; otherwise, the thermal print head 120 will perform the step 250. The predetermined value is 1 in this embodiment.

In step 240, the controlling circuit 110 will intermittently drive a heating element of thermal print head 120 corresponding to the pixel to heat the ribbon 150 within a print time corresponding to the bit $b_i$ (i.e. the print period $P_i$), in order to make the dyes on the ribbon 150 be transferred and printed onto a position of the target medium 160 corresponding to the pixel. For example, the controlling circuit 110 can alternatively enable and disable the heating element according to a clock signal (not shown), in order to attain the purpose of intermittently driving the heating element. Please note that the time length of driving the heating element each time can be the same or can be different, and the interval time between two continuous times of driving the heating element can be a fixed value or can be adjusted according to different requirements. The advantage of intermittently driving the heating element is being able to prevent the heating element from overheated due to being driven continuously. In general, the temperature of a heating element is exponentially related to the time length for the thermal print head 120 to drive the heating element continuously. More specifically, if the time length for the controlling circuit 110 driving the heating element becomes double the length, the temperature of a heating element will become more than twice in general. Since the controlling circuit 110 of the embodiment utilizes the mode of intermittently driving the heating element, the linearity between the heating temperature and the print time of the heating element can be increased effectively.

On the other hand, if the bit bi is 0, the controlling circuit 110 will not drive the heating element corresponding to the pixel within a print time corresponding to the bit $b_i$ (i.e. the print period $P_i$) (step 250).

Please note that the performing sequence of each step in the abovementioned flow chart 200 is only an embodiment, and is not a limitation of the present invention for the practical realization.

It is known from the abovementioned description that when the image color levels required to be presented by the thermal printing apparatus 100 are $2^n$, only n times of color level data transmission operations are required between the controlling circuit 110 and the thermal print head 120, and therefore the time required by the color level data transmission can be reduced significantly, and the whole printing efficiency of the thermal transfer printing apparatus 100 can be increased.

In the above-mentioned description, the controlling circuit 110 determines a print period $P_i$ corresponding to the bit $b_i$ according to the total print time Ti corresponding to each bit bi. Please note this is only an embodiment, and is not a limitation of the present invention for the practical realization. In the practical operation, the controlling circuit 110 is also able to divide the total print time Ti corresponding to the bit bi into a plurality of discrete print periods, and interleave the print periods corresponding to the different bits in order to further separate the time for the controlling circuit 110 driving the heating element.

Figure 3:
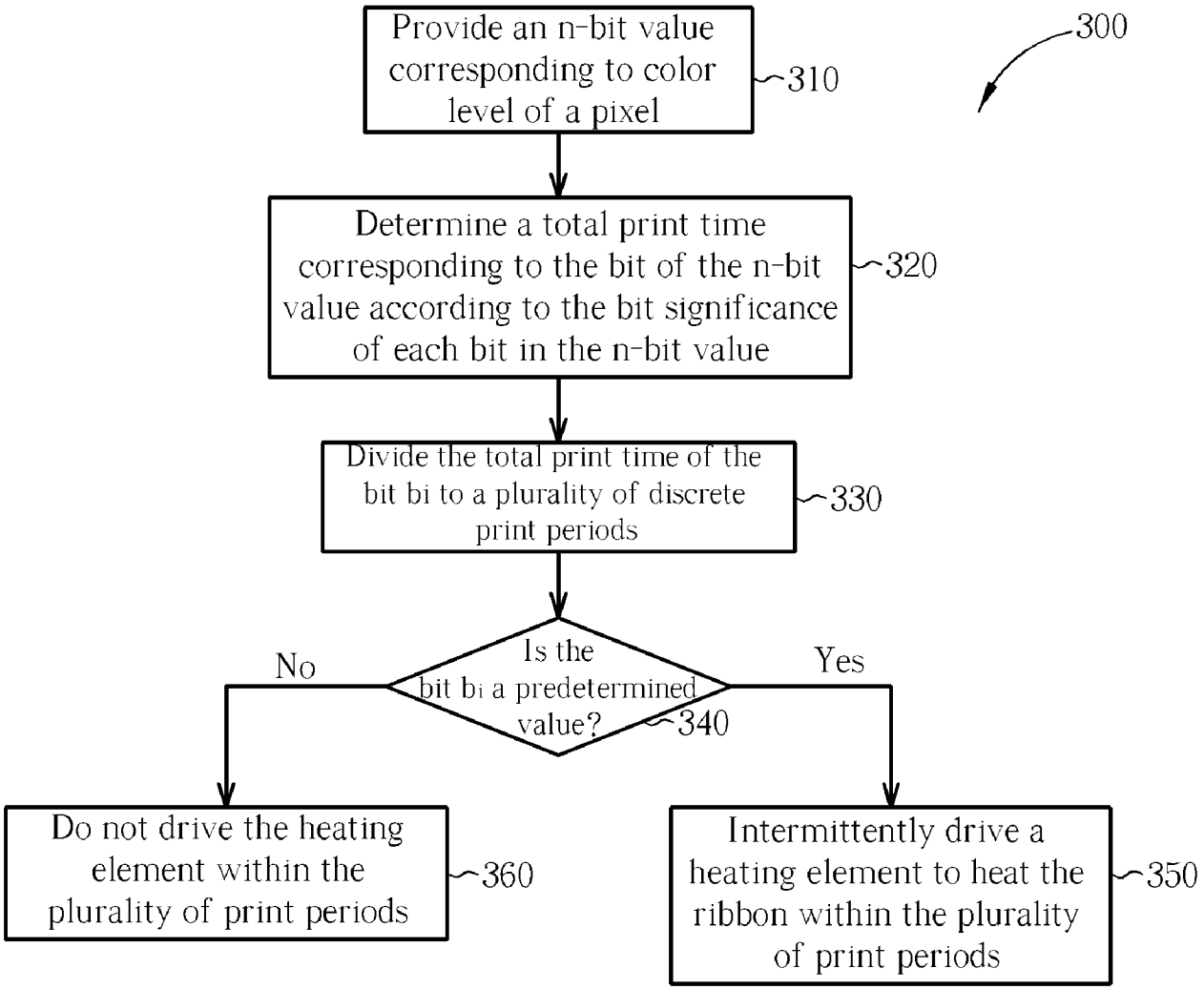
FIG. 3 is a flow chart showing a thermal printing method according to a second embodiment of the present invention.

Please refer to FIG. 3. FIG. 3 is a flow chart 300 showing a thermal printing method according to a second embodiment of the present invention. Since operations of the steps 310 and 320 in the flow chart 300 are the same as the abovementioned steps 210 and 220 substantially, further details are omitted for the sake of brevity.

Figure 4:
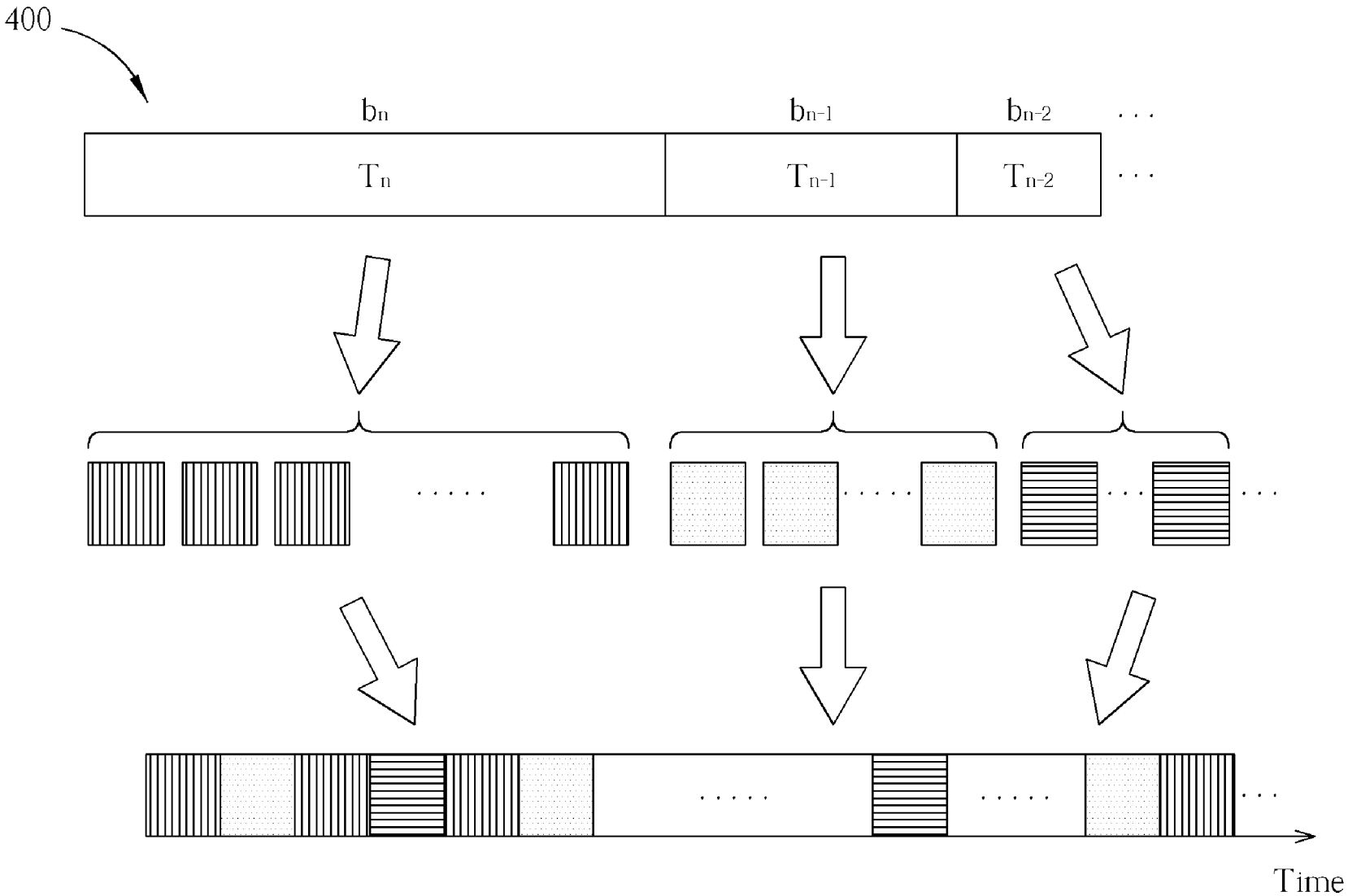
FIG. 4 is a timing diagram showing the thermal print head shown in FIG. 1 interleaving the print periods corresponding to the different bits according to an embodiment of the present invention.

In step 330, the controlling circuit 110 will divide the total print time $T_i$ corresponding to the bit $b_i$ into a plurality of discrete print periods as shown in a timing diagram 400 of FIG. 4. In FIG. 4, different net patterns are utilized for representing print periods corresponding to the different bits. For example, the vertical stripe net pattern is utilized for representing the print period corresponding to the bit $b_n$; the dot net pattern is utilized for representing the print period corresponding to the bit $b_{n-1}$; the horizontal stripe net pattern is utilized for representing the print period corresponding to the bit $b_{n-2}$. In an embodiment, the plurality of print periods corresponding to the bit $b_i$ have substantially a same time length. In another embodiment, the time length of at least a print period of the plurality of print periods is different from time lengths of the other print periods. In other words, the present invention does not have a limitation about the time length of each print period. In practical operation, the controlling circuit 110 is also able to fine-tune the time length of each print period respectively in order to perform proper heat compensation.

In step 340, the controlling circuit 110 will determine the sequential operation according to the value of each bit bi. If the bit bi is a predetermined value, the controlling circuit 110 will perform step 350; otherwise, the controlling circuit 110 will perform step 360. The predetermined value is 1 in this embodiment.

In step 350, the controlling circuit 110 will intermittently drive a heating element corresponding to the pixel to heat the ribbon 150 within the plurality of print periods corresponding to the bit $b_i$, in order to make the dyes on the ribbon 150 be transferred and printed onto a position of the target medium 160 corresponding to the pixel. As in the abovementioned embodiment, the controlling circuit 110 can alternatively enable and disable the heating element according to a clock signal (not shown), in order to attain the purpose of intermittently driving the heating element.

On the other hand, if the bit bi is 0, the controlling circuit 110 will not drive the heating element corresponding to the pixel within the plurality of print periods corresponding to the bit bi (step 360).

As shown in FIG. 4, the controlling circuit 110 is also able to interleave the print periods corresponding to the different bits in order to further separate the time for the controlling circuit 110 driving the heating element, so as to further increase the linearity between the heating temperature and the print time of the heating element. Alternatively, the thermal print head 120 is also able to respectively insert blanking periods with proper lengths into the intervals between the plurality of print periods corresponding to the same bit $b_i$, wherein the thermal print head 120 will not drive the heating element during each blanking period.

In practical operation, the controlling circuit 110 also can divide the total print time $T_i$ corresponding to the bit $b_i$ to a plurality of print periods until the bit significance of the bit $b_i$ reaches a predetermined level. For example, the thermal print head 120 can divide the total print time $T_i$ corresponding to the bit $b_i$ to a plurality of print periods until the bit $b_i$ is one of m MSBs of the n-bit value, wherein m is smaller then n.

It is known from the abovementioned description that the printing method of the present invention is able to improve the calorific capacity accumulation and distribution of the heating element of the thermal print head 120. On one hand, the printing image quality can be enhanced by improving the temperature compensation efficiency, and on the other hand, the time of waiting for heat dispersal can be reduced or the heat dispersal cost of the system can be reduced (such as reducing the amount and size of fans and heat spreaders).

Please note that the thermal printing apparatus 100 and related printing method can be applied in various electronic apparatus having image printing functions such as copiers, photo printers, card printers, and multi-function products, etc.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A printing method of a thermal printing apparatus comprising:

providing an n-bit value corresponding to a color level of a pixel, wherein the color level of the pixel ranges from 0 to $2^n-1$;

determining a total print time corresponding to a target bit of the n-bit value according to a bit significance of the target bit; and if the target bit is of a predetermined value, intermittently driving a heating unit to heat a ribbon within the print time corresponding to the target bit.

2. The printing method of claim 1, further comprising:

dividing the total print time corresponding to the target bit into a plurality of discrete print periods.

3. The printing method of claim 2, wherein the plurality of print periods interleave with print periods corresponding to other bits of the n-bit value.

4. The printing method of claim 2, wherein the plurality of print periods have substantially a same time length.

5. The printing method of claim 2, wherein a time length of at least a print period of the plurality of print periods is different from time lengths of the other print periods.

6. The printing method of claim 2, wherein the target bit is one of a plurality of most significant bits of the n-bit value.

7. The printing method of claim 1, wherein the total print time corresponding to the target bit is different from a total print time corresponding to another bit of the n-bit value.

8. The printing method of claim 1, wherein the total print time corresponding to the target bit is twice as great as a total print time corresponding to an adjacent bit of lower bit significance substantially.

9. The printing method of claim 1, wherein the step of intermittently driving the heating unit further comprises:

alternatively enabling and disabling the heating unit according to a clock signal.

10. A thermal printing apparatus comprising:

a thermal print head, comprising a heating unit; and a controlling circuit, for providing an n-bit value corresponding to a color level of a pixel and determining a print period corresponding to a target bit of the n-bit value according to a bit significance of the target bit, wherein the color level of the pixel ranges from 0 to $2^n-1$;

wherein if the target bit is of a predetermined value, the controlling circuit intermittently drives the heating unit to heat a ribbon within the print period.

11. The thermal printing apparatus of claim 10, wherein a time length of the print period corresponding to the target bit is different from a time length of a print period corresponding to another bit in the n-bit value.

12. The thermal printing apparatus of claim 10, wherein a time length of the print period corresponding to the target bit is twice as great as a time length of a print period corresponding to an adjacent bit of substantially lower bit significance.

13. The thermal printing apparatus of claim 10, wherein the controlling circuit alternatively enables and disables the heating unit according to a clock signal.

14. A thermal printing apparatus comprising:

a thermal print head, comprising a heating unit; and a controlling circuit, for providing an n-bit value corresponding to a color level of a pixel and determining a total print time corresponding to a target bit of the n-bit value according to a bit significance of the target bit and dividing the total print time into a plurality of discrete print periods, wherein the color level of the pixel ranges from 0 to $2^n-1$;

wherein if the target bit is of a predetermined value, the thermal print head intermittently drives the heating unit to heat a ribbon within the plurality of print periods.

15. The thermal printing apparatus of claim 14, wherein the plurality of print periods interleave with print periods corresponding to other bits of the n-bit value.

16. The thermal printing apparatus of claim 14, wherein the plurality of print periods have substantially a same time length.

17. The thermal printing apparatus of claim 14, wherein a time length of at least a print period of the plurality of print periods is different from time lengths of the other print periods.

18. The thermal printing apparatus of claim 14, wherein the target bit is one of a plurality of most significant bits of the n-bit value.

19. The thermal printing apparatus of claim 14, wherein the total print time corresponding to the target bit is different from a total print time corresponding to another bit of the n-bit value.

20. The thermal printing apparatus of claim 14, wherein the total print time corresponding to the target bit is twice as great as a total print time corresponding to an adjacent bit of substantially lower bit significance.

21. The thermal printing apparatus of claim 14, wherein the controlling circuit alternatively enables and disables the heating unit according to a clock signal.

* * * * *